US006932156B2

(12) United States Patent
Bayne et al.

(10) Patent No.: US 6,932,156 B2
(45) Date of Patent: Aug. 23, 2005

(54) METHOD FOR SELECTIVELY TREATING TWO PRODUCING INTERVALS IN A SINGLE TRIP

(75) Inventors: Christian F. Bayne, The Woodlands, TX (US); Perry D. Baycroft, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 87 days.

(21) Appl. No.: 10/459,074

(22) Filed: Jun. 11, 2003

(65) Prior Publication Data

US 2004/0003922 A1 Jan. 8, 2004

Related U.S. Application Data

(60) Provisional application No. 60/390,634, filed on Jun. 21, 2002.

(51) Int. Cl.[7] ..... E21B 43/04; E21B 33/124

(52) U.S. Cl. ..... 166/278; 166/51; 166/191; 166/334.4

(58) Field of Search ..... 166/278, 51, 334.4, 166/191, 133, 183

(56) References Cited

U.S. PATENT DOCUMENTS

| | | | | |
|---|---|---|---|---|
| 2,991,833 A | * | 7/1961 | Brown et al. | 166/313 |
| 4,270,608 A | | 6/1981 | Hendrickson et al. | |
| 4,273,190 A | | 6/1981 | Baker et al. | |
| 4,401,158 A | | 8/1983 | Spencer et al. | |
| 4,627,488 A | * | 12/1986 | Szarka | 166/51 |
| 4,915,172 A | * | 4/1990 | Donovan et al. | 166/278 |
| 4,945,991 A | | 8/1990 | Jones | |
| 5,082,052 A | | 1/1992 | Jones et al. | |
| 5,113,935 A | | 5/1992 | Jones et al. | |
| 5,332,039 A | * | 7/1994 | Primeaux et al. | 166/278 |
| 5,341,880 A | | 8/1994 | Thorstensen et al. | |
| 5,343,949 A | * | 9/1994 | Ross et al. | 166/278 |
| 5,373,899 A | * | 12/1994 | Dore' et al. | 166/278 |
| 5,417,284 A | | 5/1995 | Jones | |
| 5,419,394 A | | 5/1995 | Jones | |
| 5,476,143 A | | 12/1995 | Sparlin et al. | |
| 5,515,915 A | | 5/1996 | Jones et al. | |
| 5,577,559 A | | 11/1996 | Voll et al. | |
| 5,921,318 A | | 7/1999 | Ross | |
| 6,230,803 B1 | | 5/2001 | Morton et al. | |
| 6,298,916 B1 | * | 10/2001 | Tibbles et al. | 166/278 |
| 6,318,469 B1 | | 11/2001 | Patel | |
| 6,464,006 B2 | | 10/2002 | Womble | |
| 6,488,082 B2 | | 12/2002 | Echols et al. | |
| 6,575,251 B2 | * | 6/2003 | Watson et al. | 166/387 |
| 2002/0117301 A1 | | 8/2002 | Womble | |

FOREIGN PATENT DOCUMENTS

GB 2317630 A 1/1998

OTHER PUBLICATIONS

Schlumberger, Case Study: AIIFRAC multi–zome completion reduces risk and saves rig time, Dec. 2000, p. 2.*

Brannon, D.H.; Gravel Packing Dual Zones in one trip reduces offshore completion time; World Oil; Sep. 1991; 103–107.

* cited by examiner

*Primary Examiner*—David Bagnell
*Assistant Examiner*—Shane Bomar
(74) *Attorney, Agent, or Firm*—Steve Rosenblatt

(57) ABSTRACT

A method is disclosed that allows for sequential treatment of two zones in a single trip while isolating the zones. A fluid loss valve prevents the column of fluid in the tubing from flowing into the lower formation until activated. Zone isolation is accomplished by manipulation of a port on a wash pipe attached to the crossover assembly.

18 Claims, 5 Drawing Sheets

METHOD FOR SELECTIVELY TREATING TWO PRODUCING INTERVALS IN A SINGLE TRIP

PRIORITY INFORMATION

This application claims the benefit of U.S. Provisional Application No. 60/390,634 on Jun. 21, 2002.

FIELD OF THE INVENTION

The field of this invention relates to techniques and equipment to gravel-pack and treat closely spaced zones and more particularly in applications where some degree of isolation is desired between the zones for accommodating different treatment plans.

BACKGROUND OF THE INVENTION

In producing hydrocarbons or the like from loose or unconsolidated and/or fractured formations, it is not uncommon to produce large volumes of particulate material along with the formation fluids. As is well known in the art, these particulates routinely cause a variety of problems and must be controlled in order for production to be economical. A popular technique used for controlling the production of particulates (e.g., sand) from a well is one which is commonly known as "gravel-packing."

In a typical gravel-packed completion, a screen is lowered into the wellbore on a work string and is positioned adjacent to the subterranean formation to be completed, e.g., a production formation. Particulate material, collectively referred to as "gravel," and a carrier fluid is then pumped as a slurry down the work string where it exits through a "cross-over" into the well annulus formed between the screen and the well casing or open hole, as the case may be. The carrier liquid in the slurry normally flows into the formation through casing perforations, which, in turn, is sized to prevent flow of gravel therethrough. This results in the gravel being deposited or "screened out" in the well annulus where it collects to form a gravel pack around the screen. The gravel, in turn, is sized so that it forms a permeable mass, which allows the flow of the produced fluids therethrough and into the screen while blocking the flow of the particulates produced with the production fluids.

One major problem that occurs in gravel-packing single zones, particularly where they are long or inclined, arises from the difficulty in distributing the gravel over the entire completion interval, i.e., completely packing the entire length of the well annulus around the screen. This poor distribution of gravel (i.e., incomplete packing of the interval) is often caused by the carrier fluid in the gravel slurry being lost into the more permeable portions of the formation, which, in turn, causes the gravel to form "sand bridges" in the annulus before all the gravel has been placed. Such bridges block further flow of slurry through the annulus, which prevents the placement of sufficient gravel (a) below the bridge in top-to-bottom packing operations or (b) above the bridge in bottom-to-top packing operations.

To address this specific problem, "alternate path" well strings have been developed which provide for distribution of gravel throughout the entire completion interval, even if sand bridges form before all the gravel has been placed. Some examples of such screens include U.S. Pat. Nos.: 4,945,991; 5,082,052; 5,113,935; 5,417,284; 5,419,394; 5,476,143; 5,341,880; and 5,515,915. In these well screens, the alternate paths (e.g., perforated shunts or bypass conduits) extend along the length of the screen and are in fluid communication with the gravel slurry as the slurry enters the well annulus around the screen. If a sand bridge forms in the annulus, the slurry is still free to flow through the conduits and out into the annulus through the perforations in the conduits to complete the filling of the annulus above and/or below the sand bridge.

One of the problems with the alternate path design is the relatively small size of the passages through them. These tubes are also subject to being crimped or otherwise damaged during the installation of the screen. Thus, several designs in the past have placed these tubes inside the outer surface of the screen. This type of design substantially increases the cost of the screen over commercially available screens. Yet other designs have recognized that it is more economical to place such tubes on the outsides of the screen and have attempted to put yet another shroud over the alternate paths which are on the outside of the screen to prevent them from being damaged during insertion or removal. Such a design is revealed in U.K application No. GB 2317 630 A.

While such designs can be of some benefit in a bridging situation, they present difficulties in attempting to treat and gravel-pack zones which are fairly close together. Many times zones are so close together that traditional isolation devices between the zones cannot be practically employed because the spacing is too short. For example, situations occur where an upper and lower zone are spaced only 5–20 feet from each other, thus precluding a complete completion assembly in between screens for each of the zones. When these closely spaced zones are encountered, it is desirable to be able to gravel-pack and treat the formations at the same time so as to save rig time by eliminating numerous trips into the well. This method was explained in U.S. Pat. No. 6,230,803. At times these types of completions will also require some degree of isolation between them, while at the same time producing one or the other of the formations. In U.S. Pat. No. 6,230,803 a method was disclosed to facilitate fluid treatments such as fracture stimulation, as well as gravel packing, simultaneously, in two or more adjacent producing zones, while providing limited hydraulic isolation between two or more adjacent zones. That method minimized rig time for the completion by reducing the number of trips required to install the gravel screen assemblies and to treat the formation. The limitation of that method was that the two zones had to be treated simultaneously. This caused problems if the nature of the adjacent formations necessitated a different treatment program. The isolation of the zones after completion was also less than ideal. Accordingly, the present method seeks to allow the treatment of adjacent zones in a single trip one at a time so that different regimens can be used. It provides, in the preferred embodiment, a check valve for retention of fluids in the string against loss into the formation. It provides an option of isolating a zone while treating the other. The method of the present invention can also be used in a single producing zone to minimize bridging problems during gravel distribution by splitting the zone into segments and gravel packing each segment individually. These objectives and how they are accomplished will become clearer to those skilled in the art from a review of the detailed description of the preferred embodiment and the claims, which appear below.

SUMMARY OF THE INVENTION

A method is disclosed that allows for sequential treatment of two zones in a single trip while isolating the zones. A fluid loss valve prevents the column of fluid in the tubing from flowing into the lower formation until activated. Zone isolation is accomplished by manipulation of a port on a wash pipe attached to the crossover assembly.

DETAILED DESCRIPTION OF THE PREFERRED EMBODIMENT

Figure 1:
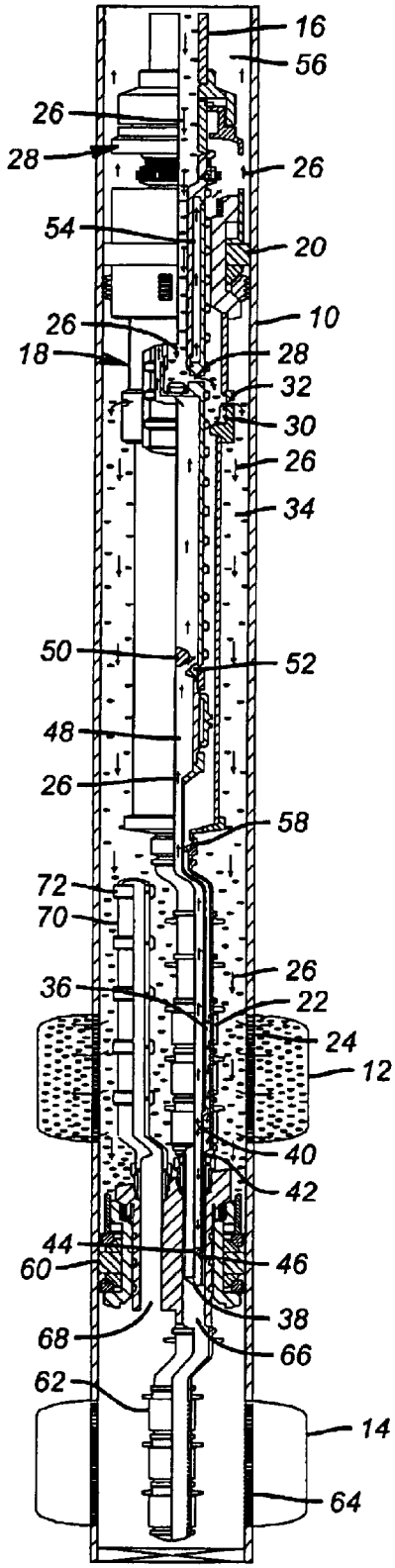
FIG. 1 is a section view of the equipment in place and the upper zone being treated while the lower zone is isolated.

FIG. 1 shows a wellbore 10 and zones 12 and 14 to be treated. The preferred embodiment illustrates the method for two zones but those skilled in the art will appreciate that additional zones can be treated in a single trip with duplication of the equipment shown for doing two zones in one trip, as will be explained below. A tubular string 16 is used to run in a known crossover tool 18, which is movable with respect to packer 20 after it is set. In FIG. 1, the packer 20 is shown in the set position and the crossover is set up to circulate to deposit gravel outside of screen 22 and adjacent the perforations 24 of zone 12. Arrows 26 show the gravel and fluid mixture coming from the surface through the string 16 and going through the packer 20. The gravel and fluid stream indicated by arrows 26 goes through crossover 18 and through ports 28 in the crossover tool 18. Sliding sleeve valve 30 is left in the open position during run in so that the ports 32 are open for the gravel and fluid stream 26 to pass into annulus 34. The stream passes through the screen 22 leaving the gravel in annulus 34 and the fluid to pass through the screen 22 into annular space 36 around the wash pipe 38. Wash pipe 38 has several openings 40 which are shown in FIG. 1 as above seal 42. Seal 42 keeps clean fluid from going down around the outside of the wash pipe 38. Any fluid 26 that gets into the wash pipe 38 through openings 40 is stopped from exiting the lower end of the wash pipe 38 by a ball 44 pushed by the flow against a seat 46. Return flow 26 passes through passage 48 lifting ball 50 off seat 52. The return flow passes through passage 54 in crossover 18 and up to the surface via annulus 56 above the set packer 20. A flapper 58 is held open by wash pipe 38. When the wash pipe 38 is removed, the flapper 58 closes to prevent the column of fluid from the surface inside the string 16 from flowing into the formation and potentially causing damage.

Figure 2:
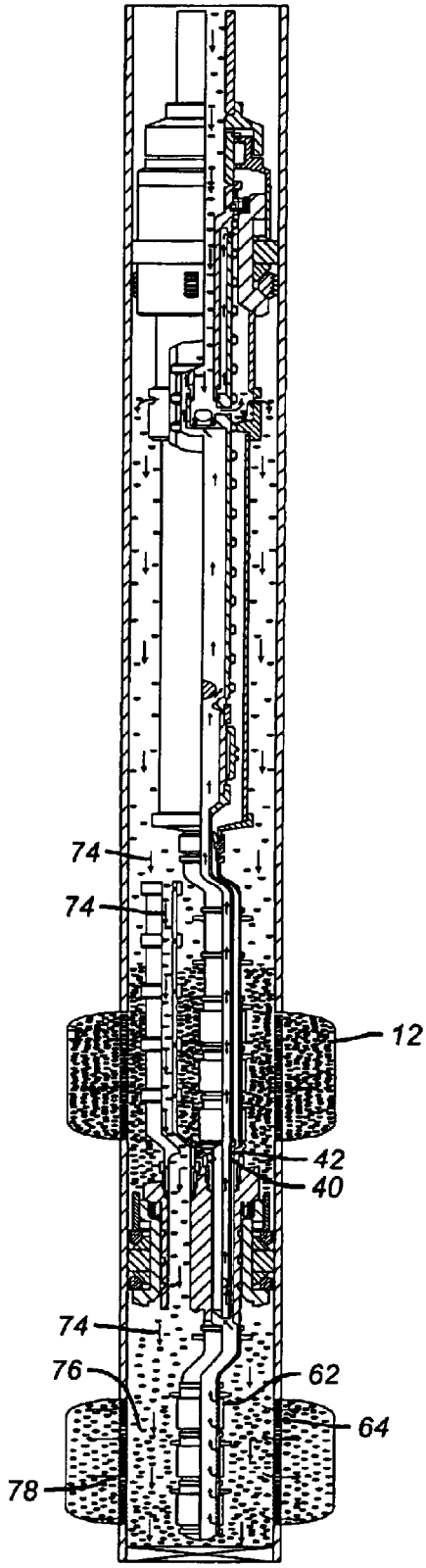
FIG. 2 is the view of FIG. 1 with the lower zone being treated.

Packer 60 is supported by screen 22 and it in turn supports screen 62 at perforations 64. Packer 60 is multi-bore. The first bore 66 communicates to inside screen 62. The second bore 68 communicates with a standpipe 70 that is capped at cap 72 at its upper end. As shown in FIG. 1 gravel is deposited around the outside of standpipe 70 and standpipe 70 extends above perforations 24. After the zone 12 is fully treated, including gravel packing and other operations that may be needed like acidizing, pressure on cap 72 can be raised to break it to provide access to zone 14 through bore 68. Cap 72 can be a rupture disc or any other type of barrier that can be removed in any number of ways among them pressure, chemical reaction or some applied force. As shown in FIG. 2, the gravel and fluid stream 74 passes through standpipe 70 and bore 68 in packer 60 to lodge in annulus 76 adjacent perforations 64. Returns pass through screen 62 and into wash pipe 38 to displace ball 44 off of seat 46. Ports 40 in wash pipe 38 are now below seal 42. This position of ports 40 effectively isolates zone 12 from returns. The returns 74 pass through passage 48 and return to the surface through annulus 56 in the manner previously described for zone 12. Thus, although the gravel packing is done from top to bottom, each zone is independent and bridging in zone 12 has no effect on the deposition of gravel in zone 14.

Figure 3:
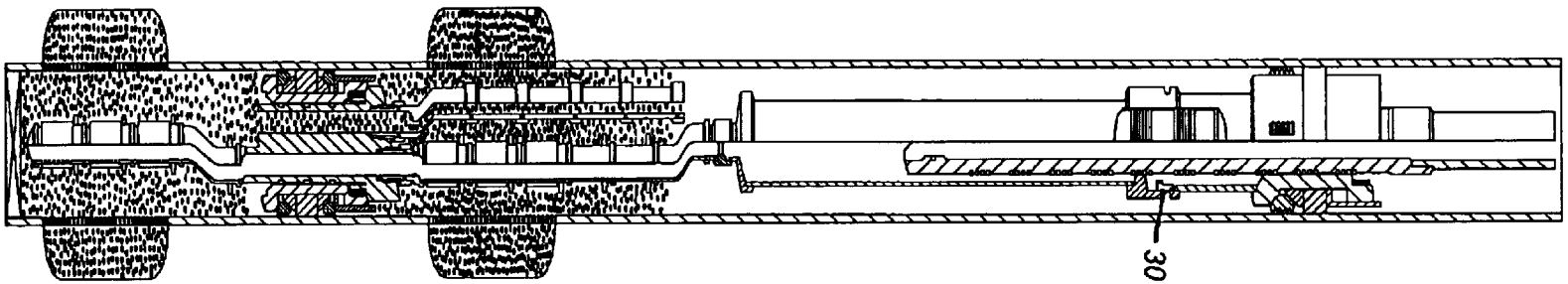
FIG. 3 shows both zones treated.

FIG. 3 shows the crossover 18 and wash pipe 38 removed. The flapper 58 has slammed shut to prevent fluid loss to either zone 12 or 14. Sliding sleeve 30 has been pushed closed by the removal of the wash pipe 38.

Figure 5:
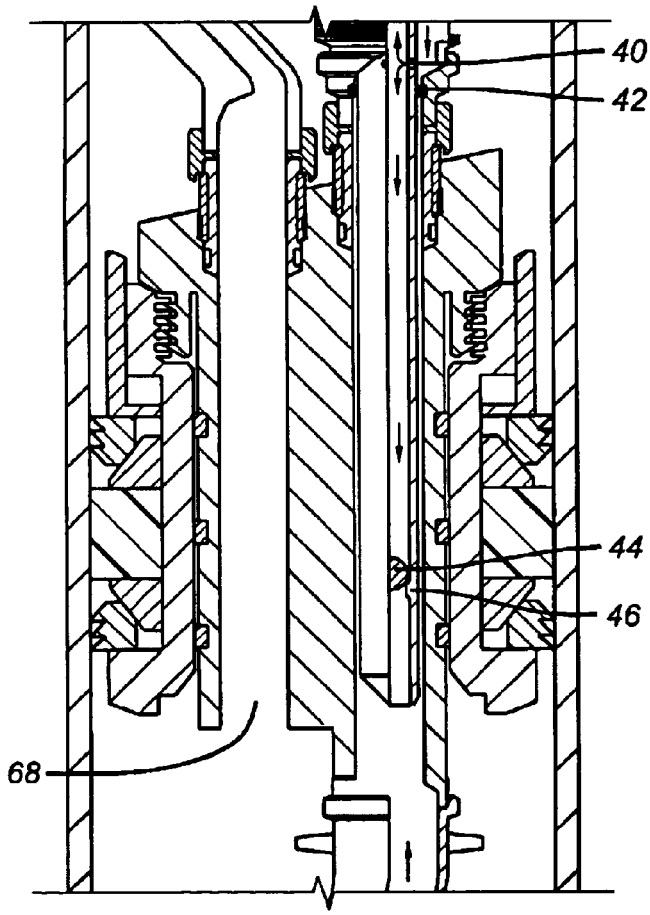
FIG. 5 is a detailed view of the wash pipe in position to allow treatment of the upper zone.
Figure 6:
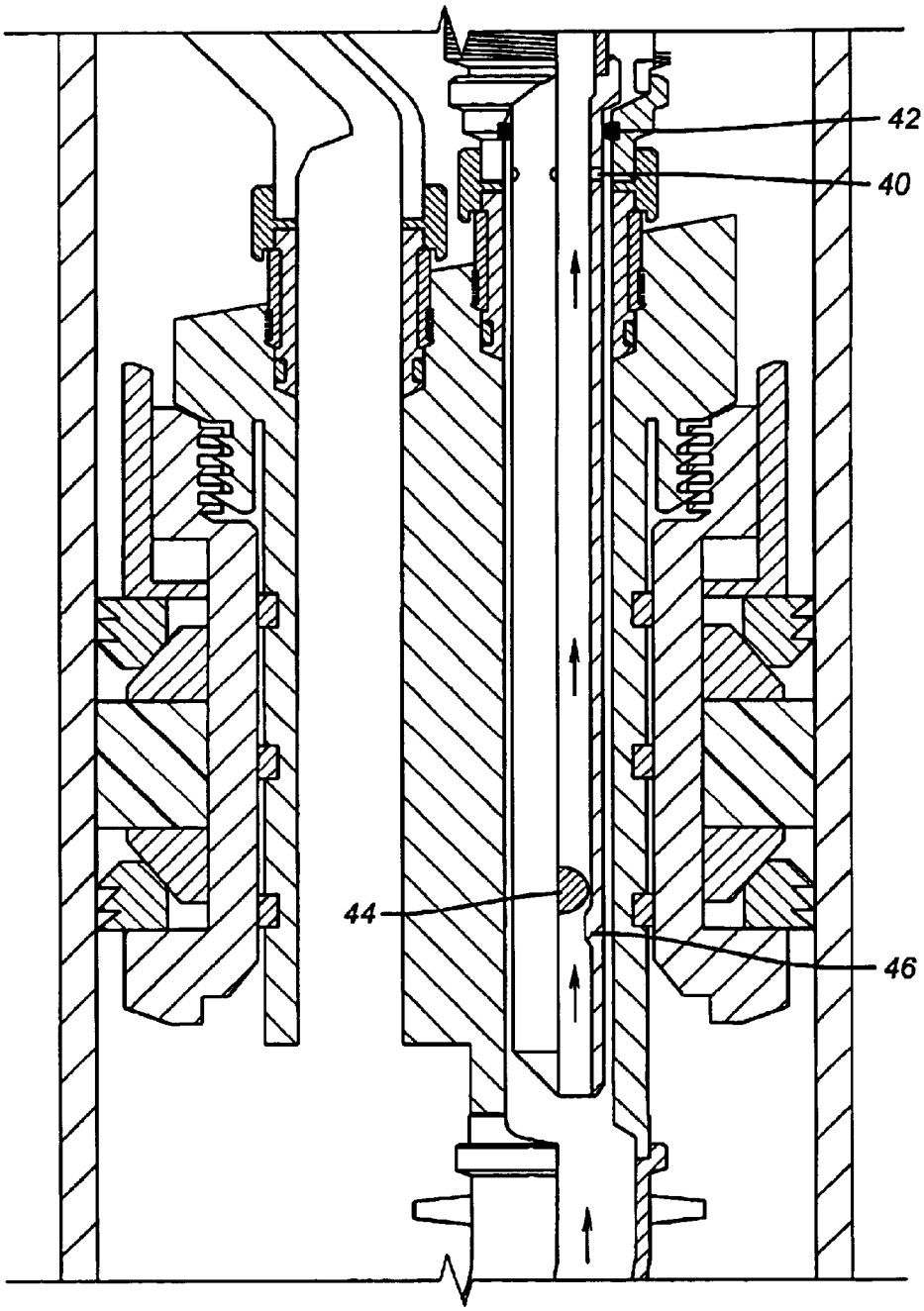
FIG. 6 is the view of FIG. 5 showing the wash pipe positioned for squeezing the lower zone.

FIG. 5 shows the isolation of the lower zone 14 when treating the upper zone 12 by virtue of having openings 40 above seal 42. Seal 42 seals around the outside of wash pipe 38 and ball 44 on seat 46 prevents returns from treating the zone 12 from reaching zone 14. Additionally, bore 68 is closed at this time by cap 72 on standpipe 70. FIG. 6 shows how zone 12 is isolated when treating zone 14. Here the returns lift ball 44 off of seat 46. Ports 40 are now below seal 42 forcing all returns to bypass zone 12 and rise to the crossover 18. It should be noted that the cross-over 18 can be configured to close access to surface annulus 56, in which case the gravel packing or acid treating or any other procedure will be without returns or by bull heading into the formation.

Figure 4:
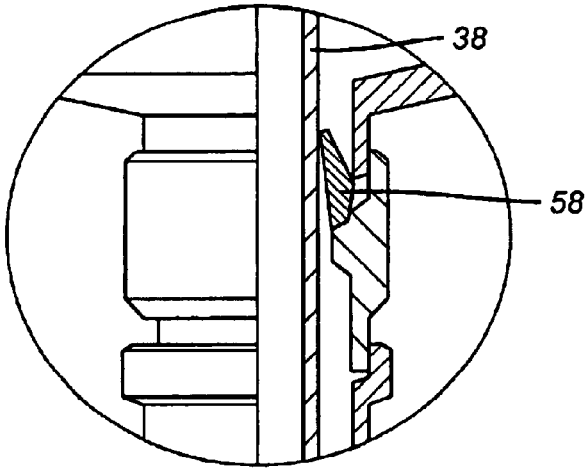
FIG. 4 is an enlargement of the fluid loss prevention valve in the assembly.

FIG. 4 simply illustrates the flapper 58 held open by the wash pipe 38. It slams shut as soon as the wash pipe 38 is removed.

Those skilled in the art will appreciate that the zones can be closely spaced and can be treated separately in a single trip. Two or more zones can be sequentially treated in a single trip. The treatment can be by circulation with returns to the surface or elsewhere or without returns with the fluids driven into the formation being treated. When treating two zones, one is isolated when the other is treated. Finally, a fluid loss prevention feature, which is a flapper 58 in the preferred embodiment retains the liquid column in the tubular 16 and prevents its passage into the formation. The fluid prevention feature can be a flapper or ball device or any other valve that hold up the liquid column when the wash pipe 38 is pulled out.

The above description is illustrative of the preferred embodiment and many modifications may be made by those skilled in the art without departing from the invention whose scope is to be determined from the literal and equivalent scope of the claims below:

We claim:

1. A method of independently treating at least two zones in a single trip downhole, comprising:

running in an outer assembly comprising a lower screen and an upper screen separated by an isolation packer;

running in an upper packer above said upper screen;

running in an inner assembly comprising a crossover with a wash pipe connected so that said wash pipe extends from said crossover located at least in part in said upper packer while said wash sealingly engages said isolation packer in a first passage therethrough, said inner assembly defining an upper annulus from said upper packer to the surface;

selectively providing a return path through either said upper or lower screen through manipulating said crossover while said crossover extends, at least in part, into said upper packer.

2. The method of claim 1, comprising:

manipulating a first port on said wash pipe to opposing sides of said sealing engagement to select a return path through said upper or lower screen.

3. The method of claim 2, comprising:

locating said first port laterally on said wash pipe;

providing said sealing of said inner assembly to said isolation packer with a peripheral seal on said isolation packer;

shifting the position of said lateral port between above and below said peripheral seal to elect a return path from said upper or lower screen.

4. The method of claim 3, comprising:

providing a second port into said wash pipe below said peripheral seal;

providing a check valve in said second port.

5. The method of claim 4, comprising:

using said check valve to allow flow into said inner assembly but not out of said inner assembly.

6. The method of claim 5, comprising:

locating said first port above said peripheral seal;

taking return flow from said upper screen through said first port; and using said check valve to prevent said return flow from exiting said wash pipe through said second port.

7. The method of claim 5, comprising:

providing a second passage through said isolation packer; and selectively obstructing said second passage.

8. The method of claim 7, comprising:

removing said obstruction from said second passage;

locating said first port below said peripheral seal to isolate it from said upper screen;

taking return flow from said lower screen into said second port and through said check valve.

9. The method of claim 3, comprising:

providing a second passage through said isolation packer; and selectively obstructing said second passage;

delivering treatment material to an annulus outside said upper screen with said second passage obstructed.

10. The method of claim 9, comprising:

providing a standpipe on said second passage to extend above said upper screen and above treatment material delivered to an annulus outside said upper screen.

11. The method of claim 10, comprising:

moving said lateral port below said peripheral seal;

removing said obstruction from said second passage;

delivering treatment material to an annulus around said lower screen through said second passage.

12. The method of claim 11, comprising:

providing a second port into said inner assembly below said peripheral seal;

providing a check valve in said second port;

taking returns from said lower screen through said second port.

13. The method of claim 12, comprising:

providing a check valve in the outer assembly to hold fluid above said upper screen when said inner assembly is removed from said outer assembly.

14. The method of claim 1, comprising:

delivering treatment material to an annulus around said upper screen;

using said isolation packer to selectively prevent treatment material from entering an annulus around said lower screen.

15. The method of claim 14, comprising:

providing a second passage through said isolation packer; and selectively obstructing said second passage.

16. The method of claim 15, comprising:

providing a standpipe on said second passage to extend above said upper screen.

17. The method of claim 16, comprising:

locating a removable member in said standpipe;

removing said removable member when treatment material is to be delivered to the annulus around said lower screen.

18. The method of claim 1, comprising:

providing a check valve in the outer assembly to hold fluid above said upper screen when said inner assembly is removed from said outer assembly.

* * * * *